US006621891B2

(12) United States Patent
Danielsson

(10) Patent No.: US 6,621,891 B2
(45) Date of Patent: Sep. 16, 2003

(54) METHOD AND ARRANGEMENT RELATING TO X-RAY DETECTION

(75) Inventor: Mats Danielsson, Täby (SE)

(73) Assignee: Mamea Imaging AB, Stockholm (SE)

( * ) Notice: Subject to any disclaimer, the term of this patent is extended or adjusted under 35 U.S.C. 154(b) by 0 days.

(21) Appl. No.: 10/201,832

(22) Filed: Jul. 23, 2002

(65) Prior Publication Data

US 2003/0012341 A1 Jan. 16, 2003

Related U.S. Application Data

(63) Continuation of application No. PCT/SE01/00139, filed on Jan. 24, 2001.

(60) Provisional application No. 60/195,359, filed on Jan. 24, 2000.

(30) Foreign Application Priority Data

Jan. 24, 2002 (SE) ..... 0000228-7

(51) Int. Cl.[7] ..... G21K 1/04

(52) U.S. Cl. ..... 378/150; 378/149; 378/152

(58) Field of Search ..... 378/145, 147, 378/148, 149, 150, 151, 152; 250/505.1; 359/641

(56) References Cited

U.S. PATENT DOCUMENTS

| | | | | |
|---|---|---|---|---|
| 4,143,273 A | | 3/1979 | Richey et al. | 378/150 |
| 4,493,098 A | * | 1/1985 | Riihimaki et al. | 378/146 |
| 4,778,997 A | | 10/1988 | Döring | |
| 4,937,453 A | | 6/1990 | Nelson | |
| 4,953,189 A | | 8/1990 | Wang | |
| 5,136,627 A | | 8/1992 | Conrads et al. | |
| 6,266,393 B1 | * | 7/2001 | Ein-Gal | 378/147 |
| 6,388,816 B2 | * | 5/2002 | Brown et al. | 378/147 |

FOREIGN PATENT DOCUMENTS

| | | |
|---|---|---|
| WO | WO/99/23859 | 5/1999 |

* cited by examiner

*Primary Examiner*—Drew A. Dunn
(74) *Attorney, Agent, or Firm*—Oppedahl & Larson LLP

(57) ABSTRACT

A method an arrangement in an x-ray imaging apparatus (10), includes at least one x-ray source (11), a collimator **(42, 52, 62*a*, 62*b*, 72) and a detcetor (43, 73); the arrangement is arranged for providing a variable exposure of the dector (43, 73) to x-ray radiation from the x-ray source (10) through slots (45, 55, 65*a*, 65*b*, 75) on the collimator (42, 52, 62*a*, 62*b*, 72). The arrangement comprises at least one of the collimator (42, 52, 62*a*,** 62*b*, 72) or registering means (43, 73), which are arranged moveable relative each other to vary number of x-rays registered by the dector.

3 Claims, 4 Drawing Sheets

METHOD AND ARRANGEMENT RELATING TO X-RAY DETECTION

This application is a continuation of International Application Serial No. PCT/SE01/00139, filed on Jan. 24, 2001, and published in English under PCT Article 21(2), and which claims the benefit of U.S. Provisional Application No. 60/195,359, filed Jan. 24, 2000.

TECHNICAL FIELD OF THE INVENTION

The present invention relates to a method and arrangement for varying the exposed surface of an x-ray detection/registering means. The x-ray imaging apparatus comprises at least one x-ray source, a collimator having slots and a registering means.

BACKGROUND OF THE INVENTION

When analysing an object, specially a tissue or a part of human body, through x-ray radiation, the result of the analyse depends highly on the number of x-rays passing through the object and registered by means of a detector or film. The thickness and density of different objects are some parameters that effect the passage of the x-rays. In for example mammography examination the x-ray apparatus must be adjusted for different patients having different bodily characteristics.

In case of an x-ray detector, one important parameter is the radiated area, i.e., the surface of the detector, which is exposed to the x-rays. Yet another important parameter is the time of exposure, which in case of living tissues is critical, as the radiation dose corresponding to a long exposure time for x-ray radiation may endanger the tissue by inducing cancer.

Semiconductor based x-ray detectors are known, e.g. through Swedish Patent Application No. 9801677-7, Danielsson. According to this document an edge-on detector is placed tilted with respect to the incident x-rays.

According to the pending Swedish patent application no. 9903559-4, an arrangement for detecting x-ray radiations is provided comprising a carrying member on one face arranged with detectors consisting of a plurality of sensors arranged on a substrate. The detectors are arranged substantially edge to edge at least in one row on at least one side of said carrying member.

U.S. Pat. No. 4,937,453, describes an apparatus for detecting x-ray radiation in a radiographic imaging context is disclosed. It is particularly useful in conjunction with slot and slot scan radiography. In accordance with this invention, detectors are constructed and arranged such that substantially all of the energy from an x-ray to be detected is discharged in the detector. In this way a detector is provided which provides a direct electronic read out, high x-ray stopping power and high spatial resolution while obtaining good signal collection efficiency without the use of excessively high voltage levels. In the preferred embodiment, solid-state x-ray detectors are constructed such that the thickness of the detector along the direction of incident X-rays is long enough that substantially all of the x-ray energy is discharged in the detector. The detector is arranged edge on, with its longitudinal axis substantially parallel to the incident x-ray.

Also, gas-based detectors are known. WO 99/23859, for example concerns an apparatus for radiography, and especially for planar beam radiography, and also a detector for detecting incident radiation. The detector according to this invention, which detects incident radiation, is a gaseous parallel plate avalanche chamber, including electrode arrangements between which a voltage is applied for creating an electrical field, which causes electron-ion avalanches of primary and secondary ionization electrons released by incident radiation. The detector is oriented, in relation to the incident radiation, so that the radiation enters sideways between a first and a second parallel plate, between which the electrical field is created. Electrical signals induced by said electron-ion avalanches are detected in at least one detector electrode arrangement, including a plurality of detector electrode elements arranged adjacent to each other, each along a direction being essentially parallel to the incident radiation.

U.S. Pat. No. 4,953,189 discloses a method and device for producing flux equalized x-ray images for medical radiography through the use of a scanning fan shaped x-ray beam and a feedback control system which regulates the beam intensity at a multiple number of points along the fan beam to compensate for the x-ray attenuation variations of the patient.

According to U.S. Pat. No. 5,136,672, at least one primary diaphragm comprises two elements displaceable so as to form a linear fan-shaped beam, which is incident on an object to be examined. The elements form the slit-shaped aperture forming the fan beam in their normal X-ray beam forming position and are moveable to a respective, selectable limit position perpendicularly to the fan shaped beam in order to define and mark an examination zone greater in cross-section area than the fan beam with a light beam. Light incident on the examination zone is restricted by the diaphragm elements in their limit positions, thus marking the examination zone with the light beam. X-ray exposure of the object to be examined takes place only when the elements are between the two positions defining the examination zone of the primary diaphragm where its diaphragm elements occupy in their respective limit positions.

SUMMARY OF THE INVENTION

The main object of the present invention is to provide a method and arrangement, which enable varying the number of detected x-rays, preferably depending on the features of the object to be examined.

Preferably, the invention is applicable in the applications using scanned slot set-up.

Another object of the invention is to adjust the spatial resolution to comply with the diagnostic requirements for the moment by varying the slot width.

Therefore the initially mentioned collimator arrangement comprises at least two substantially similar collimator parts having similar slot configurations arranged on top of each other and that said substantially similar collimator parts are arranged displaceable relative each other. According to one preferred embodiment, the slots of each collimator part are arranged displaced relative each other along a longitudinal axis of the collimator.

According to another embodiment said slots of each collimator part are arranged along a longitudinal axis of the collimator.

The registering means can be one of a semiconductor-based detector, a gas-based detector or an x-ray sensitive film.

In an x-ray imaging apparatus comprising at least one x-ray source, a collimator arrangement and a registering means, the collimator arrangement being provided for varying an exposure areas of said registering means to x-ray radiation from said x-ray source, the invention relates to a method for providing said variable exposure of said registering means. The method comprises providing said collimator arrangement with at least two substantially similar collimator parts having similar slot configurations and arranging said parts on top of each other displaceable relative each other.

BRIEF DESCRIPTION OF THE DRAWINGS

In the following, the invention will be further described in a non-limiting way under reference to the accompanying drawings, in which.

DETAILED DESCRIPTION OF THE EMBODIMENTS

In x-ray imaging the number of detected x-rays determines the image acquisition time yielding an acceptable image quality. In a scanned slot set up it is thus possible to adjust the required image acquisition time by changing the width of the slots and thus the number of x-ray hitting the object and the detector. Note that the detector needs to be wider than the largest slot used in order to detect all incident x-rays. In scanned slot x-ray imaging the spatial resolution in the dimension orthogonal to the slot is determined by the slot width. By varying the slot width it is possible to adjust the spatial resolution to comply with the diagnostic requirements for the moment.

Figure 1:
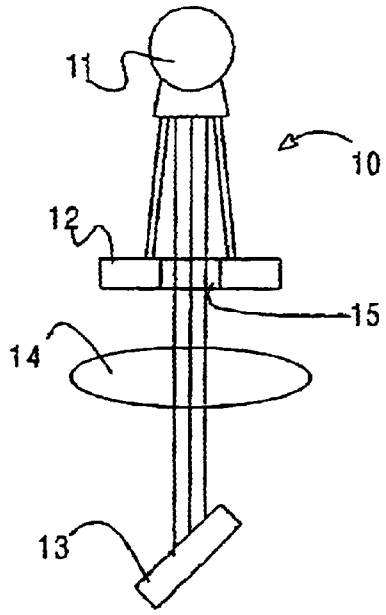
Fig. 1 PRIOR ART
FIG. 1 is a schematic side view of a known x-ray imaging apparatus.

For the invention essential parts of an x-ray imaging apparatus 10 according to known techniques are illustrated in FIG. 1. Other parts present in the apparatus, obvious for a skilled person, but not important for the invention are not shown for simplicity reasons. The simplified x-ray imaging apparatus comprises a radiation source 11, a collimator 12 and a detector assembly 13. An object 14 to be examined is located between the collimator 12 and the detector assembly 13.

Figure 2A:
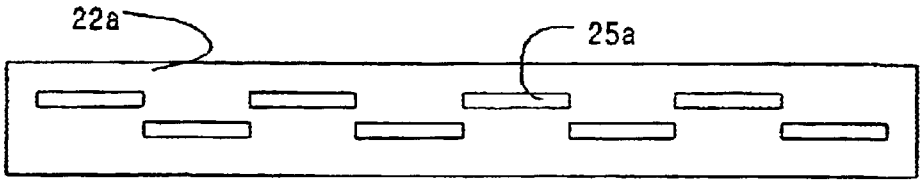
Fig. 2a PRIOR ART
FIGS. 2*a* and 2*b* are lateral views of two different multi-slot collimators according to prior art.
Figure 2B:
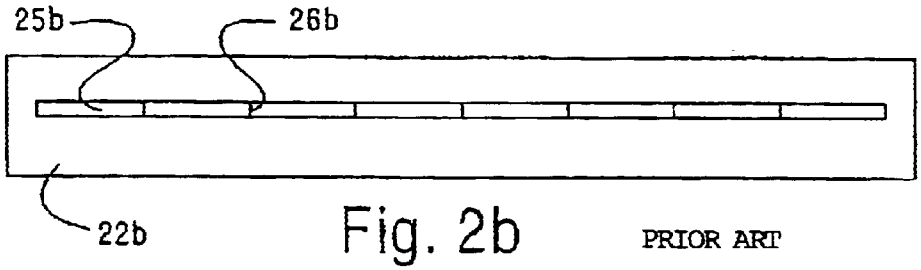
Fig. 2b PRIOR ART

The collimator is made of an x-ray blocking material and is arranged to expose a determined part of the detector for x-rays through slots 15. Two different types of collimators are illustrated in FIGS. 2*a* and 2*b*. The collimator 22*a* of FIG. 2*a* is provided with slots 25*a* arranged in two rows and displaced relative each other along the longitudinal axis of the collimator. The collimator 22*b* of FIG. 2*b* is provided with an oblong slot 25*b*, which can be divided into smaller slots through partition walls 26*b*. The form and arrangement of the slots are described in more detail in prior art as disclosed above. The collimator may comprise a 30 line slots or 30 plus 30 half lines. The slots and corresponding detectors may in some cases also be cut with an angle different from 90 degrees with respect to the scanning motion.

Figure 3:
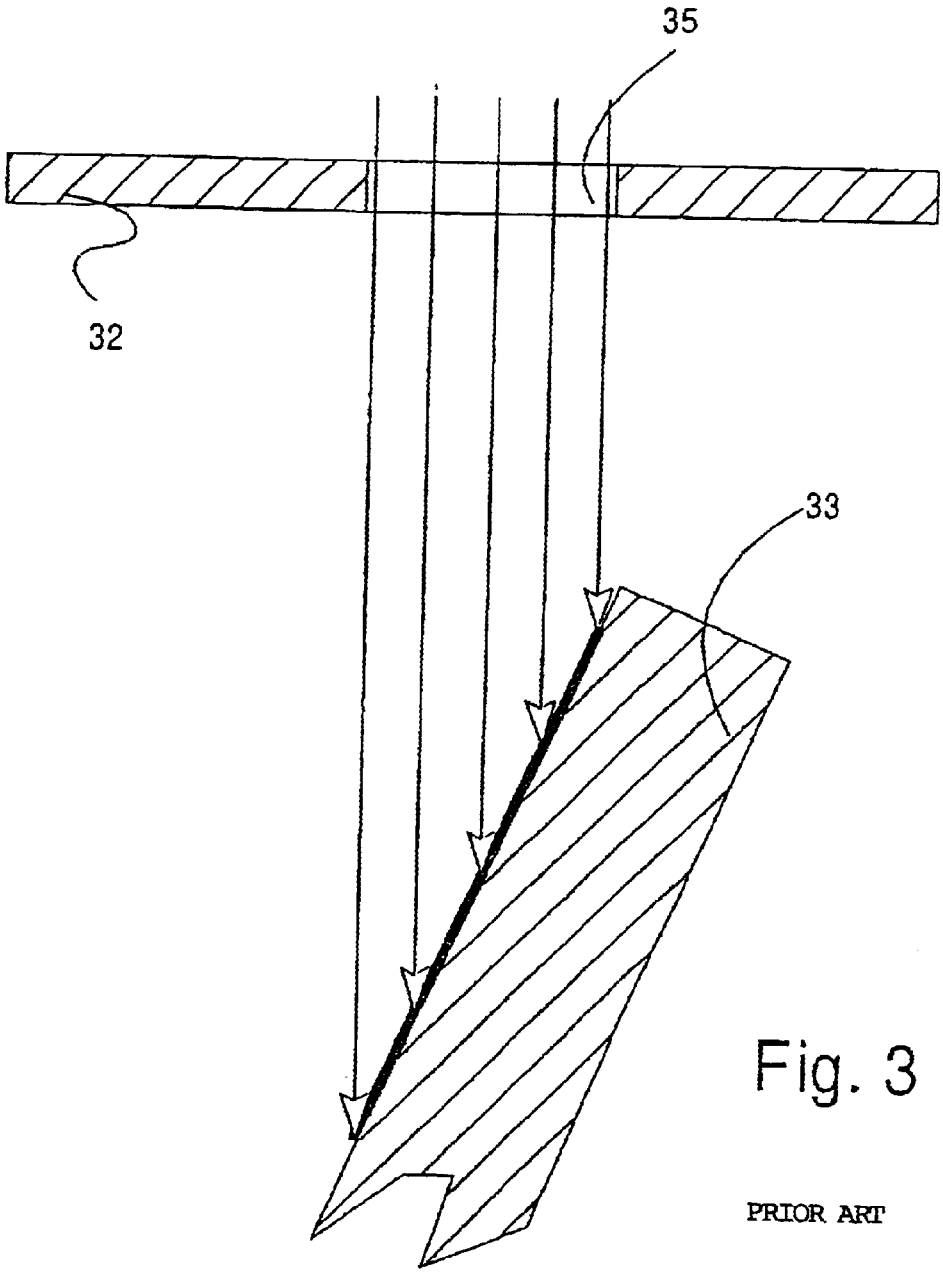
Fig. 3 PRIOR ART
FIG. 3 is a schematic and exaggerated cross-sectional view of a (multi-slot) collimator and a detector assembly according to FIG. 1.

FIG. 3 illustrates a schematic collimator-detector assembly, in which a collimator 32 having slots 35 is arranged to expose a predetermined part of the detector 33 to the x-ray radiation (indicated with arrows). The surface section of the detector 33 exposed to the radiation is indicated with a thicker line.

According to the invention, the objective of the invention is obtained by varying the exposed surface of the detector to the x-rays, it is the projection of the slot(s) on the detector.

Figure 4:
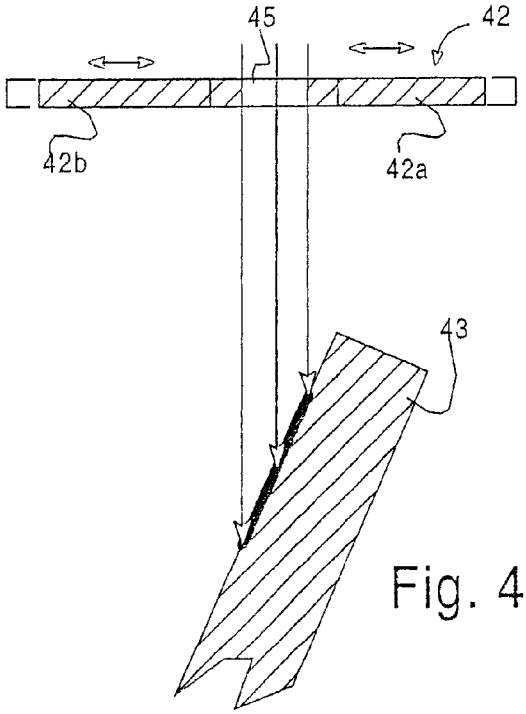
FIG. 4 is a schematic and exaggerated cross-sectional view of a collimator and a detector assembly according to the invention.
Figure 5:
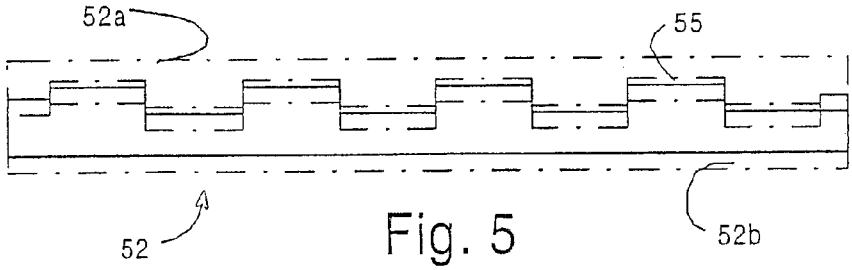
FIG. 5 is a top view of a collimator according to the invention.
Figure 6:
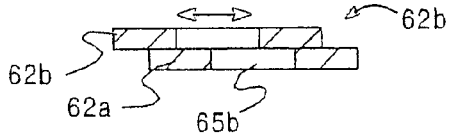
FIG. 6 is a cross-sectional view of a collimator according to FIGS. 4 and 5.

An embodiment according to the invention is illustrated in FIGS. 4, 5 and 6. According to the embodiment of FIG. 4, a collimator 42 comprises at least two relative each other displaceable parts 42*a* and 42*b*, which provide slots 45 with variable width. The parts are arranged in different planes. A first position of the collimator sections providing a maximal slot width is indicated with dashed lines. A minimal slot width (=0 mm) is obtained when no slot are placed in front of each other. It is also possible to arrange both parts laterally displaceable relative each other.

FIG. 5 is a top view of a collimator 52 comprising a first part 52*a* and a second part 52*b* arranged movable relative each other, e.g. through insertion of one part into the other one. Hence, the width of each slot 55 is variable. One position of the collimator parts providing a wide slot width is illustrated with dashed lines and a second position, in which the slot width is narrow is illustrated with solid line. The displacement of the collimator parts may be achieved by means of a step-motor (not shown) or the like by providing one or both of the parts with, e.g. teeth/wheel, belt or the like. The step motor may be controlled by means of a computer unit, e.g. with respect to the objects' density and/or thickness.

In FIG. 6, the collimator 52, comprises two substantially similar collimators, a first (stationary) part 52*a* with a fixed slot 55*a* width, and a second movable part 52*b* having a slots 55*b* similar to the first part, arranged to be displaced on one side of the first part to cover the slots 55*a* and change the slot-width. By arranging collimators on top of each other one can adjust the slot width for all slots by one single movement of collimators relative to each other in the dimension orthogonal to the slots.

Although, the examples show collimators with slots displaced relative a longitudinal axis of the collimator, it is however possible to use the same technique for collimators having slots along a longitudinal axis of the collimator.

The mechanical displacement of the second part can be accomplished using a step-motor (not shown) or the like, e.g. by providing the second part with teeth/wheel, belt or the like, or piezoelectric actuators. The motor/actuator may be controlled by means of a computer unit, e.g., with respect to the objects' density and/or thickness.

Moreover, the invention also allows providing collimators with high precession. Slots are very small recesses in a carrier, each slot having a width of for example 50 $\mu$m, which is difficult to produce depending on the manufacturing process and material. However, it is possible to produce collimators with 150 $\mu$m slots and arrange them according to the provisions of the invention to achieve smaller slot widths. It is especially useful in case of complex slot configurations. Thus, the invention provides means for producing high precession collimators.

Figure 7:
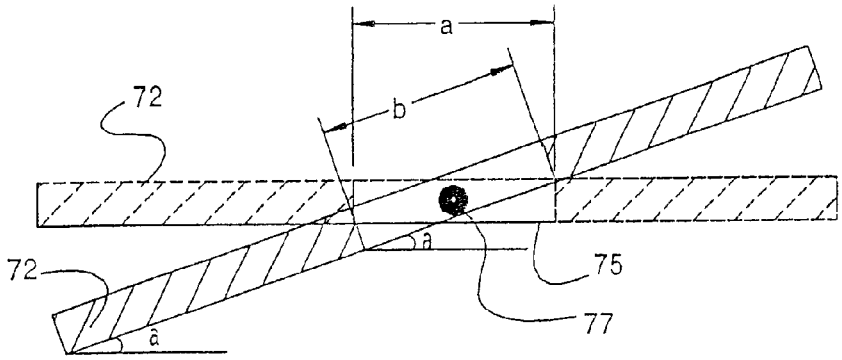
FIG. 7 is a schematic and exaggerated cross-sectional view of a collimator.
Figure 7:
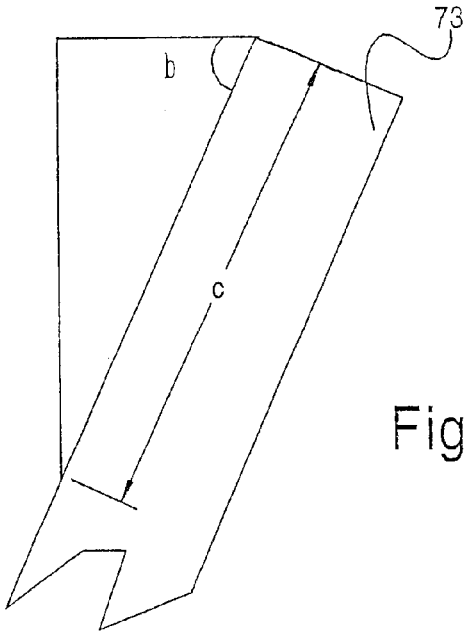

FIG. 7 is a further embodiment. The collimator 72 is arranged rotatable along a longitudinal axis 77 (anywhere along the short side of the substantially rectangular shaped collimator). According to this embodiment, the variation of exposed area is achieved by rotating the collimator 72 so that the slot 75 is positioned in an angle $\alpha$, then if assuming the width of the slot is b and the width of a section exposed through the slot is $\alpha$, then the variation of $\alpha$: $\Delta\alpha$ is obtained through $\Delta\alpha$=b. cos $\Delta\alpha$ (for $\alpha$=0, a=b). Consequently, the width of the section c, exposed to the radiation, on the tilted detector 73, tilted in an angle $\beta$ is: $c=\alpha/\cos\beta$ and accordingly the variation of c: $\Delta c$=b. cos $\Delta\alpha/\cos\beta$. A first position of the collimator 72 is shown with dashed line and a second rotated position with the solid line.

The mechanical rotation can be accomplished using a step-motor (not shown) or the like through providing the second part with, e.g. teeth/wheel, belt or the like or piezoelectric actuators (not shown). The motor/actuator may be controlled by means of a computer unit, e.g. with respect to the objects' density and/or thickness.

It is also possible to provide both the detector and the collimator rotatable. Consequently, the collimator can be both rotatable and comprise of parts for varying the slots.

The detector may be any of detectors mentioned in the background part of the present specification and do not need to be tilted as shown in the various embodiments.

The invention is not limited to the shown embodiments and can be varied in a number of ways without departing from the scope of the appended claims and the arrangement and the method can be implemented in various ways depending on application, functional units, needs and requirements etc. In one embodiment it is possible to rotate the tilted detector to change the tilting angle with respect to the slot. Instead of detectors it is also possible to use a film, known per se, in which case additional collimators should be arranged after the object to be examined. It is also possible to stack more than two collimator parts.

What is claimed is:

1. A collimator arrangement in a digital X-ray imaging apparatus comprising at least one X-ray source and a registering means, said collimator arrangement being provided for varying an exposure area of said registering means to X-ray radiation from said X-ray source, said varying being dependent on a tilt angle associated with the registering means, said collimator arrangement comprising at least two substantially similar collimator parts, namely a first part and second part, each part comprising a carrier, each being provided with similar slot configurations arranged along a longitudinal axis of the said carrier, wherein said first collimator part is arranged on one surface of said second collimator part and tat said substantially similar collimator parts are arranged to slide relative each other in a transversal direction.

2. The arrangement according to claim 1, wherein said registering means is one of a semiconductor-based detector, a gas-based detector or an X-ray sensitive film.

3. A method for providing a variable exposure of registering means to X-ray radiation from an X-ray source within an X-ray imaging apparatus, sad apparatus including a collimator arrangement comprising at least two substantially similar collimator parts, of which each one of a first part and second part includes a carrier provided with similar slot configurations, the method comprising the step of:

varying the collimator arrangement, where said varying is dependent on a tilt angle associated with the registering means, wherein the steps of varying the collimator arrangement further comprises:

arranging said first collimator part on one surface of said second collimator part; and sliding said substantially similar collimator parts relative each other in a transversal direction, enabling adjusting a spatial resolution in a dimension orthogonal to said slots.

* * * * *